United States Patent [19]

Canter

[11] 4,002,041

[45] Jan. 11, 1977

[54] THERMOSTAT CONTROL SYSTEM FOR AN AUTOMATIC ICE MAKER

[75] Inventor: James Allen Canter, Englewood, Ohio

[73] Assignee: General Motors Corporation, Detroit, Mich.

[22] Filed: June 18, 1975

[21] Appl. No.: 588,062

[52] U.S. Cl. ..... 62/137; 62/135; 62/202; 337/331

[51] Int. Cl.[2] ..... F25C 1/10

[58] Field of Search ..... 62/135, 137, 353, 202; 337/331

[56] References Cited

UNITED STATES PATENTS

| | | | |
|---|---|---|---|
| 3,028,464 | 4/1962 | Zearfoss, Jr. | 337/331 X |
| 3,540,227 | 11/1970 | Eyman, Jr. et al. | 62/137 |
| 3,751,939 | 8/1973 | Bright | 62/137 |

*Primary Examiner*—William E. Wayner
*Attorney, Agent, or Firm*—Edward P. Barthel

[57] ABSTRACT

An automatic ice maker having a motor starting circuit that is unaffected by barometric pressure changes thus obviating the need for altitude adjustment of the ice maker. A mercury column thermostatic sensor is used to provide control that will be accurate regardless of the ambient or altitude pressure while also having the ability to rapidly reset, thus eliminating the need for a back contact thermostat. The sensor, upon sensing the last ice cube to freeze in the ice tray, opens so that a rectifier SCR will be switched to conducting, shorting out a diode bridge circuit and energizing the ice maker motor after which the basic ice maker circuits lock the motor in its running mode for one cycle of ice harvesting.

3 Claims, 5 Drawing Figures

THERMOSTAT CONTROL SYSTEM FOR AN AUTOMATIC ICE MAKER

This invention relates to automatic ice makers and is directed to a mercury thermostat motor starting circuit for the ice maker which is fast acting and unaffected by barometric pressure changes.

In prior art ice makers the motor which operates the mechanism is usually started by a conventional thermostat having a gas-filled sensing tube and bellows arrangement that is affected by barometric pressure changes at differing altitudes resulting in a changed setting of the ice maker. Such conventional thermostats also have the tendency of not resetting fast enough and thereby limiting the ice making capacity of the ice maker. Examples of ice maker circuits are U.S. Pat. No. 3,540,227 to Eyman, Jr. et al. and U.S. Pat. No. 3,751,939 to Bright, both of which are assigned to the assignee of the instant application. In addition, as disclosed in the Bright patent, a source of heat must be provided at the bellows to maintain the control point at the ice tray. Such a heating means is a source of potential service problems as too little or too much heat may be applied thereby altering the operational point of the thermostat, requiring a call for service by the customer.

It is therefore an object of the present invention to provide an improved thermostatic control circuit for a refrigerator automatic ice maker that will be accurate in response regardless of the ambient or altitude pressure at which the refrigerator is located, and which will reset quickly for increased ice making capacity.

It is another object of the present invention to provide an improved automatic ice maker for a domestic refrigerator having a mercury column ice tray sensor thermostat ice tray sensor obviating the barometric pressure effects caused by differing altitudes at which the ice maker is used and also providing a rapid resetting wherein the control circuit operates such that on a fall of temperature the mercury sensor switch opens causing a rectifier SCR to switch to conducting shorting out a diode bridge circuit energizing the ice maker motor which starts the basic ice maker circuit locking the motor in its running mode for one cycle of ice harvesting, after which incoming fill water warms and closes the mercury thermostatic switch in preparation for the next ice making cycle.

Further objects and advantages of the present invention will be apparent from the following description, reference being had to the accompanying drawings, wherein a preferred embodiment of the present invention is clearly shown.

Figure 1:
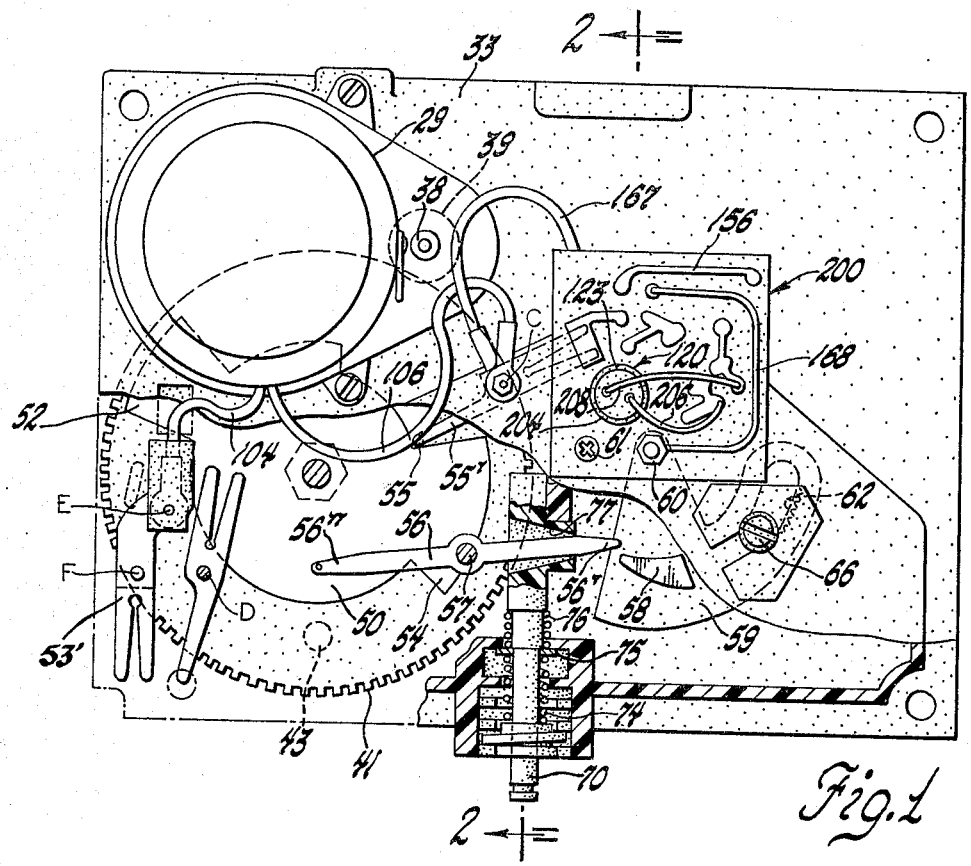
FIG. 1 is an elevational front view of the electrical control plate and printed circuit board of an automatic ice maker.
Figure 2:
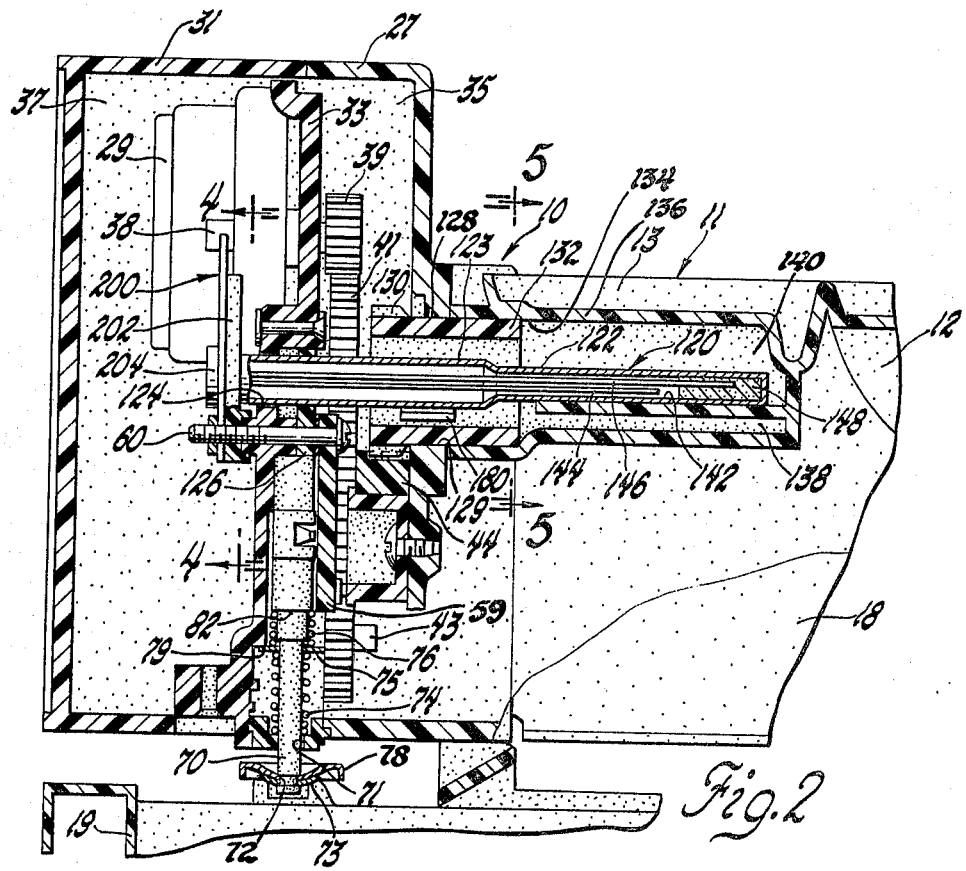
FIG. 2 is a vertical sectional view taken substantially on the line 2—2 of FIG. 1.

Referring now to the drawings, and more particularly to FIGS. 1 and 2, there is shown the electrical circuit control plate of a domestic refrigerator automatic ice maker 10 of the general type disclosed in U.S. Pat. No. 3,540,227 to Eyman, Jr. et al., and assigned to the assignee of the instant application, the disclosure of which is incorporated by reference herein. The ice maker comprises a mold or tray 11 formed of plastic material such as polypropylene, defining a plurality of pockets such as the two rows of pockets 12 with each row having four ice making pockets therein. The tray has an upwardly flanged rim 13 extending around the short and long sides with the tray adapted to receive fill water to be frozen into a plurality of ice pieces or cubes. The ice maker has a wide U-shaped frame 18 which surrounds the tray 11 while seated directly below the frame is a rectangular bin, partially shown at 19, for receiving and storing the frozen ice pieces ejected from the tray.

As explained in the mentioned Eyman patent, for accessibility all the mechanism and controls of the automatic ice maker are located at the front of the refrigerator freezer with ice tray rotating and twisting mechanism and control system therefor being located in a rear housing 27 while electric driving motor 29 and the wiring are located within a front housing 31. Thus, as seen in FIG. 1, substantially the entire operating and control mechanism are arranged upon a regular plastic upright dividing wall 33 which divides the interior of the housing into rear 35 and front 37 compartments. The front compartment 37 contains the drive motor 20 having its final drive shaft 38 extending through the dividing wall 33 and provided with a drive pinion 39 on the opposite side which continually meshes with a large driven commutator gear 41 with the drive pinion 39 and commutator gear 41 shown in hidden lines in FIG. 1. As further shown and explained in the Eyman patent, the ice maker mechanism includes the commutator gear 41 provided with an eccentrically located crank pin 43 which extends through an upright yoke (not shown) integrally with a horizontal rack bar 44. The yoke is in the form of an elongated irregular loop operated by crank pin 43 to reciprocate the rack bar and rotate the front of the tray in one direction (clockwise) a few degrees creating a gradual twist to break the cube away from the pockets. It returns the tray to the horizontal position, then rotates in the opposite direction (counterclockwise). As the tray reaches a vertical position and the cubes are beginning to fall from the tray, the tray is given another twist. This is accomplished by a stop (not shown) which momentarily holds the rear of the tray while the front continues to rotate in said opposite direction. As the front of the tray continues to rotate, the rear is pulled off of the stop producing a snap action to insure positive cube release. After the tray reaches a point approximately 45° beyond the vertical (partially turned over) it returns to a horizontal position by rotating clockwise. The overall travel time for the complete harvest cycle is approximately 3 minutes. During the harvest cycle, after the tray begins to rotate in said opposite direction, there is a point just before the ice cubes fall free, that the mechanism will pause if the storage bin 19 has been removed. This gives the user the opportunity to replace the bin before the cubes fall from the tray. As shown schematically in FIG. 3, an electrically conductive commutator plate 50, mounted on the outer face of gear 41, includes a fill projection or segment 52 cooperating with a ball-type contact 53 of spring arm 53′ to measure the fill period by the time required for the fill projection 52 to move past the contact 53. The commutator plate 50 also includes delay projection or segment 54 which cooperates with contact 55 of angular spring arm 55'.

A long pivoted spring arm member 56 pivoted on pin 57 has diametrically opposed contacts with one of the contacts 56' engaging a metallic wedge-shaped contact 58 of a plastic segment contact member 59 pivoted upon a pivot pin in the form of a machine bolt 60. The wedge-shaped contact 58 is adapted to be contacted by the contact 56' when the long arm member 56 is adjacent its horizontal position and to be out of contact with contact 56' whenever arm member 56 is pivoted a substantial distance either up or down away from its horizontal position. The ice control switch segment member, shown schematically at 59' in FIG. 3, may be pivoted about its pivot pin 60 through a limited arc by having its internal gear segment 62 engaged by a small pinion (not shown) connected to a shaft 66 having a bearing within an aperture in the wall 33 and extending through the front housing of the ice maker to a knob (not shown) in the front wall of the housing 31. For a complete showing and description of the ice control mechanism reference may be had to the above-mentioned Eyman et al. patent.

As seen in FIG. 1, resting upon the weigh switch shaft or rod 70 which is vertically slidably mounted through an aperture 71 in the bottom of the upright dividing wall 33 projects through the bottom thereof and through a slot 72 in the front cross member of the bin carrier 19. The bottom of this rod is provided with a C-shaped disc retainer 73 which is keyed thereto and which supports the front cross member of the bin carrier 19.

Resting upon the projection of the upright dividing wall 33 and surrounding the aperture 71 and the weigh shaft 70 is a small coil spring 74 which is sufficiently strong to support the bin 19 until it is substantially filled the desired amount with ice cubes or frozen liquid. The top of the spring 74 presses against the disc 75 surrounding the weigh rod which is normally held against the shoulder upon the wall 33 by the spring 74. The spring 74 is limited in its expansion by being confined between the wall surrounding the aperture and the shoulder. Above the disc is a still smaller and weaker coil spring 76 which surrounds the weigh rod 70 between the disc and a shoulder upon the shaft below the V-notch 77. This light spring 76 is of such a force as to be able to support and lift the bin carrier 78 when the disc 75 is against the shoulder 79 but is not able to support the carrier 78 and bin 19.

The pivoted long contact 56 has its pivot and wedge-shaped contact so coordinated with the springs 74 and 76 which are in additive relationship together with the positions of the lower aperture of the wall portion 33 and the shoulders 79 and 82 so that whenever the bin is removed from the carrier 78 the spring 74 will raise the weigh rod 70 and the adjacent right end of the pivoted long contact 56 to lift the contact portion 56' above the arc-shaped upper edge of the wedge-shaped contact 58 to open the circuit. The pivoted long contact 56 is bowed so that only the contact points 56' and 56'' make contact with the commutator and the wedge-shaped contact. When the bin 19 is placed in proper position on the carrier 78 the spring 76 will be pressed down until the contact 56' is in engagement with the upper edge portion of the wedge-shaped contact 58 and the contact is in engagement with commutator 50.

Figure 3:
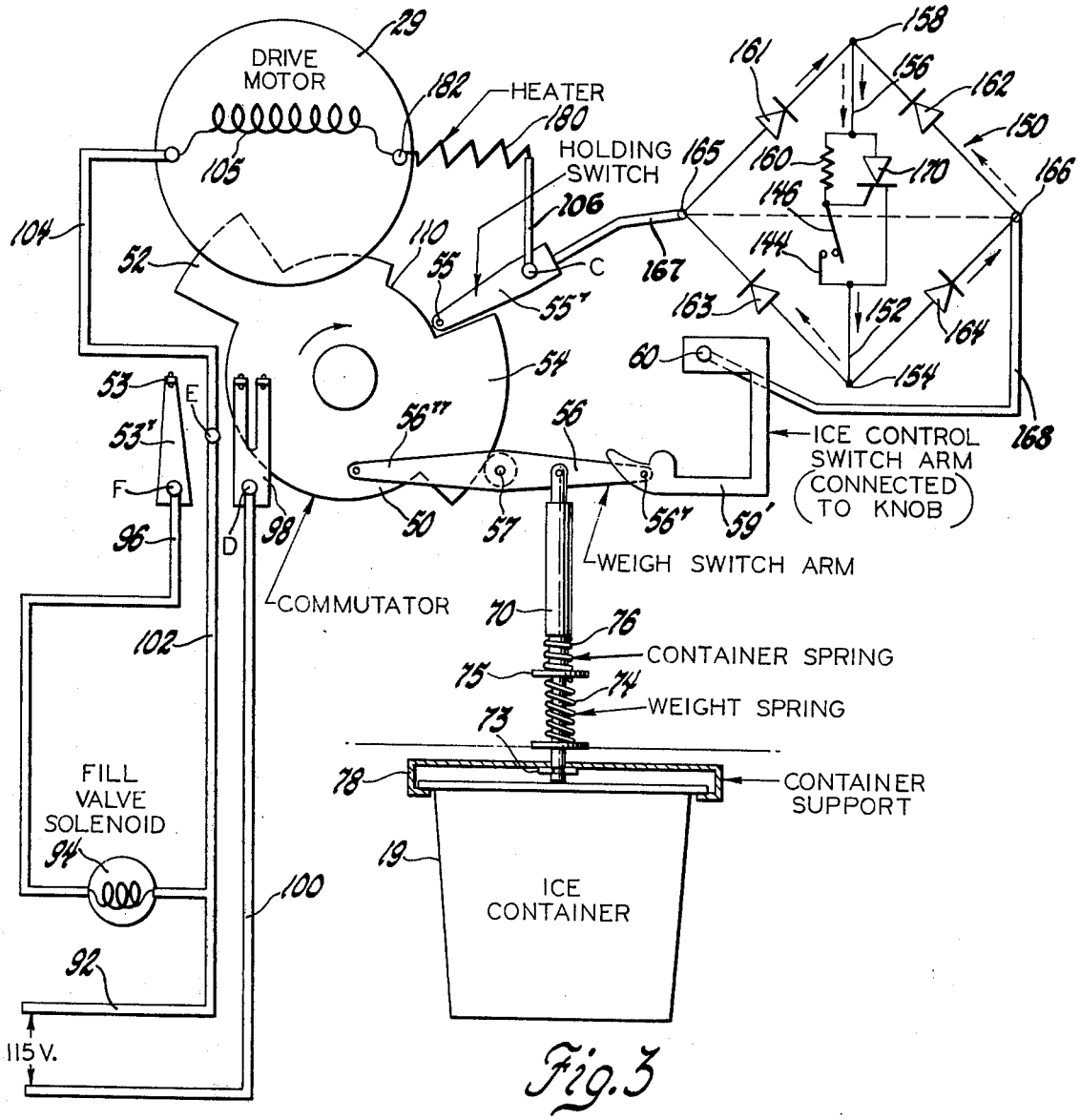
FIG. 3 is a diagrammatic view of an electrical system with a schematic of the printed circuit for the apparatus.

The control system is more easily understood from the diagram of FIG. 3 which shows the fill contact 53 out of contact with the fill projection 53 indicating that the filling operation has been completed. While the fill contact 53 is in contact with the projection 52 as it rotates in a clockwise manner, it completes a circuit from the supply conductor 92 through the solenoid operated fill valve 94 and the conductor 96, via post F through the contact 53 to the segment 52 through which current will flow, via post D, to the forked leaf spring contact 98 connected with the second supply conductor 100. This position of the commutator 50 means that the drive motor 29 is also connected in parallel with fill valve 94 through the conductor 102, which extends from the supply conductor 92 to the conductor 104, connected with one side of the drive motor windings 105. A second conductor 106 connects with the spring type holding switch arm 55', via post C, whose contact 55 is with the commutator 40. This energization continues as the large gear 39 and the commutator 50 are rotated in a clockwise direction at a rate which is timed by the constant speed of the synchronous drive motor 29. This provides a time period of engagement of the contact 53 with the commutator fill projection 52 which moves upwardly at a constant speed until the projection 52 moves away from the contact 53 to deenergize the solenoid fill valve 94. During this energization of the fill valve 94 water flows from a supply source through a pipe and out the discharge device into the tray 11.

The drive motor 29, however, continues its operation through the holding contact 55 being in engagement with the commutator 50. The contact 55 engages the commutator 50 at all times excepting when the notch 110 is oriented as shown. The clockwise rotation of the large gear and the commutator 50 continues until the delay projection 54 passes beneath the holding contact 55 and the notch 110 begins to pass beneath the contact 55. Further clockwise movement of the commutator 50 is under the control of a mercury column ice cube tray sensing thermostat and motor control circuit which will now be described.

Figure 5:
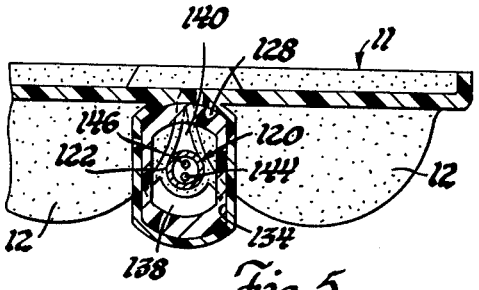
FIG. 5 is a vertical sectional view on line 5—5 of FIG. 2.

A mercury column thermostatic switch, generally indicated at 120 in FIG. 2, includes an axially extending elongated metal sensing tube, preferably formed of aluminum having an inner reduced portion 122 and an enlarged front end portion 123 which extends through an opening 124 in the wall 33 and an aligned opening in inner plastic mounting bracket 126 secured to wall 33 by bolt 60 and Phillips head screw 61. The sensing tube is thus supported in cantilevered fashion from the wall 33 with its front end 123 extending through coaxial concentric tray pinion gear sleeve 128 which sleeve extends through and is rotatably mounted in a bearing passage 129 on the base wall of the housing 27. The sleeve 128 has an interrupted pinion or spur gear 130 on its front end which cooperates with the rack bar 44 having teeth that mesh with the pinion gear 130. As seen in FIG. 5, the sleeve 128 is provided with flattened parallel external side surfaces 132 which fit tightly within conforming locking socket 134 of boss 136 integral with the tray and located between the tray front or forwardmost ice cube pickets 12. A lower insulating air space 138 is formed by arcuate wall 139 in the boss socket 134 partially surrounding upper boss cavity 140 defined in part by the adjacent walls of the front pockets or cavities 12 to telescopically receive the temperature sensing tube portion 122 such that the axis of the tube coincides with the pivotal axis of the tray and the tube is in heat transfer relation with the walls of the forwardmost cavities 12.

As seen in FIG. 2 the tube bore 142 has a pair of wire lead conductor contacts 144 and 146 extending axially therein with the contact lead 144 being of a predetermined lesser length than the contact lead 146. A pool or column of liquid mercury 148 is located in the closed end of the sealed bore 142 such that under above-freezing temperatures the mercury column expands outwardly toward the sealed end 204 of the bore 142 to immerse or wet the free ends of both lead contacts 144 and 146 to complete the circuit therebetween and close the mercury thermostat. Upon the water charge freezing in the tray forwardmost cavities the mercury column 148 contracts to the position shown in FIG. 2 whereupon the contacts 144 and 146 are opened.

With reference to the schematic diagram of FIG. 3 it will be seen that the mercury thermostat switch contacts 144, 146 are electrically connected between the direct current or D.C. diagonal terminals of a diode bridge, generally indicated at 150, by means of conductor 152 connected to bridge negative terminal 154 and conductor 156 connected to bridge positive terminal 158. It will be noted that a current limiting resistor 160 is located in series between terminal 158 and contact 146.

In the diode bridge 150 the four diodes (161, 162, 163 and 164) are arranged so that the cathodes of diodes 161 and 162 are connected together at 158 and the anodes of diodes 163 and 164 are connected together at 154. The alternating current or A.C. input to the bridge is applied alternately to the anode of diode 161 and the cathode of diode 163 at one terminal 165 during one half cycle and to the anode diode 162 and the cathode of diode 164 at terminal 166 during the other half cycle. Terminal 165 is connected by lead 167 to post C while terminal 166 is connected by lead 168 to pin 60.

With the unfrozen water in the tray 11, contacts 144 and 146 are closed and the diode bridge is shorted out of the circuit. When the temperature falls below predetermined point, about 28° F. in the disclosed form, the mercury thermostat 120 senses the last ice cube in the tray to freeze and the contacts 144 and 146 open causing an SCR 170, having its anode connected to conductor 156 and its cathode connected to conductor 152, to switch ON shorting out the diode bridge 150 and energizing the motor 29. The current flow in the circuit is in the direction of the solid arrows when the terminal 165 is charged negative and the terminal 166 is positive while the current flow is in the direction of the dashed arrows when the terminal 165 is charged positive and the terminal 166 is charged negative.

Upon the energization of the motor 29, the basic ice maker circuit described locks the motor in its running mode for one cycle of ice harvest by having the commutator plate 50 advanced in a clockwise direction until the holding switch arm contact 55 is closed to the commutator plate at which point the tray 11 begins its first twist as described in the mentioned Eyman patent. After the ice harvest cycle the incoming water warms the mercury thermostat closing its contacts 144, 146 to start the next freezing cycle.

As seen in FIG. 3 a resistance heater 180 may be placed in the circuit between the terminal 182 of the motor 29 and the conductor 106 connected to post C. The purpose of the optional heater 180 is as follows: If a user turns off the ice maker and allows the mercury thermostat sensor tube 122 to become very cold, the incoming water, after the initial harvest, either has insufficient time or inadequate heat available to reset the mercury thermostat sensor. The result is a false cycle which dumps unfrozen tray water into the ice cube storage bin 19. By means of heater 180 applicant is able to provide a source of heat directly to the mercury thermostat aluminum sensing tube 122 during the motor 29 operational cycle thereby insuring that the thermostat 120 will reset in the single water fill cycle time interval.

Applicant's disclosed form of the invention provides the heater 180 in series with the drive motor 29 with the heater 180 located physically in snug surface contact with the outer enlarged portion 123 of the aluminum sensing tube as shown in FIG. 2. It will be appreciated that because the aluminum sensing tube 122 is a good conductor of heat the tube will allow thermal conduction from the heater 180 to the mercury at the distal closed free end of the tube without interfering with the ability of the tube to sense the temperature of the frozen ice cubes in the tray 11. In the form shown the aluminum sensing tube has an overall length of about 3.75 inches with its large end 123 having an outer diameter of about 0.3120 inches and its reduced inner end having an outer diameter of about 0.200 inches and a lengthof about 1.82 inches. The thermostat must open at 12.5° F. and be able to withstand +150° F. and −30° F. Also the thermostat must be able to withstand 1250 volts 60 Hz between its leads and armor without breakdown.

Figure 4:
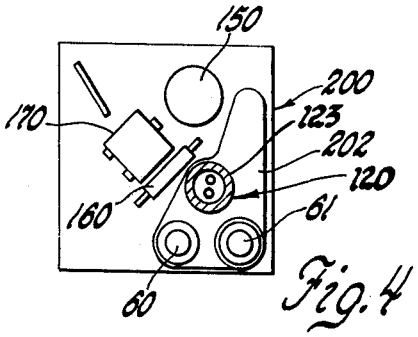
FIG. 4 is a vertical sectional view on line 4—4 of FIG. 2.

As seen in FIG. 1, the circuit portion of the improved temperature sensing arrangement of the subject invention is incorporated in an insulator board 200, stationarily mounted by means of bolt 60 outwardly from the partition wall 33. The board 200 is provided on its outer side with an electric current conductive printed circuit and carries or has mounted on its inner side, as shown in FIG. 4, the diode bridge 150, the SCR 170 and the biasing resistor 160 along with a mounting base 202 for the mercury thermostat 120. It will be noted in FIG. 1 that the open end of the sensing tube enlarged portion 123 is sealed at 204 with epoxy with conductor 206 connected to one side of resistor 160 and conductor 208 connected to the anode of the SCR and the terminal 158 of the diode bridge. Preferably the epoxy is Scotch-Brand cast No. 8 or equivalent to withstand freeze and thaw cycling.

While the embodiment of the present invention as herein disclosed constitutes a preferred form, it is to be understood that other forms might be adopted.

I claim:

1. In an automatic ice maker for use within a freezer compartment including an ice tray, an electric drive motor including field windings, tray drive gear means operated by said motor for rotating said tray about its longitudinal axis so as to harvest ice pieces therefrom, a thermal ice harvesting control mechanism comprising: a mercury thermostat including a temperature sensing metal tube positioned within a longitudinal chamber in said tray with said tube principal axis coinciding with said tray rotational axis, said tube having an axial bore with a pool of liquid mercury at its closed inner end responsive to the temperature of the water change in the tray ice piece forming cavities, a pair of conducting wires extending into said bore at differing axial distances, means for hermetically sealing the front open end of said tube bore, such that upon the mercury pool sensing a below freezing temperature of the water charge in said tray cavities said mercury contracts axially toward the closed end of said bore causing disengagement of said mercury from the shorter of said pair of wire conductors and opening the mercury thermostat, circuit means connecting said motor field windings across the alternating-current output terminals of a full-wave diode bridge circuit, said wire conductors being connected between the direct-current terminals of said diode bridge, said diode bridge having an SCR switch connected in parallel with said wire conductors between said bridge direct-current terminals, whereby upon said mercury thermostat opening said SCR conducts to trigger each half cycle of said diode bridge circuit energizing said drive motor field winding causing rotation of said tray to harvest the ice pieces from said ice maker tray.

2. An automatic ice piece maker comprising: a front wall support, a plastic ice tray for forming ice pieces mounted for rotatable movement on said support for use within a freezing compartment, wherein harvesting of ice pieces from said tray is effected by rotating said tray through a predetermined arc, an electric drive motor mounted on said support, tray drive gear means on said support operated by said drive motor for rotating said tray about its longitudinal axis, a mercury thermostat including a temperature sensing metal tube mounted on said support and extending rearwardly therefrom, said metal tube having a reduced inner portion telescopically received within a longitudinal integral chamber formed in said tray, said tube having its principal axis coinciding with said tray rotational axis, said tube reduced end in thermally responsive relation with the tray forwardmost ice piece forming cavities, said tube having an axial bore with a pool of liquid mercury at its closed inner end, a pair of conducting wire contacts extending into said bore at differing axial distances, means for hermetically sealing the front open end of said tube bore, such that upon the liquid mercury sensing a below freezing temperature of the water in said tray forwardmost cavities the liquid mercury contracts axially toward the closed end of said bore causing disengagement of said mercury pool from the shorter of said pair of wire contacts thereby opening said mercury thermostat, circuit means connecting the field winding of said drive motor across the alternating current terminals of a full-wave diode bridge, said wire conductors being connected to the direct current terminals of said diode bridge, said diode bridge having an SCR switch connected in parallel with said wire conductors between said direct current terminals, whereby upon said mercury thermostat opening said SCR switch conducts to trigger each half cycle of said bridge circuit energizing said drive motor field winding during the harvest cycle of said ice maker.

3. An automatic ice piece maker comprising: a front wall support, a plastic ice tray for forming ice pieces mounted for rotatable movement on said support for use within a freezing compartment, wherein harvesting of ice pieces from said tray is effected by rotating said tray through a predetermined arc, an electric synchronous drive motor mounted on said support, tray drive gear means on said support operated by said drive motor for rotating said tray about its longitudinal axis, a mercury thermostat including a temperature sensing metal tube mounted on said support and extending rearwardly therefrom, said metal tube having a reduced inner portion telescopically received within a longitudinal integral chamber formed in said tray, said tube having its principal axis coinciding with said tray rotational axis, said tube reduced end in thermally responsive relation with the tray forwardmost ice piece forming cavities, said tube having an enlarged outer end, resistance heater means in heating engagement with the outer surface of said tube enlarged end, said tube having an axial bore with a pool of liquid mercury at its closed inner end, a pair of conducting wire contacts extending into said bore at differing axial distances, means for hermetically sealing the front open end of said tube bore, such that upon the liquid mercury sensing a below freezing temperature of the water in said tray forwardmost cavities the liquid mercury contracts axially toward the closed end of said bore causing disengagement of said mercury pool from the shorter of said pair of wire contacts thereby opening said mercury thermostat, circuit means connecting the field winding of said drive motor in series with said heater means said series connected field winding and heater means being connected across the alternating current terminals of a full-wave diode bridge, said wire contacts being connected to the direct current terminals of said diode bridge, said diode bridge having an SCR switch connected in parallel with said wire conductors between said direct current terminals, whereby upon said mercury thermostat opening said SCR switch conducts to trigger each half cycle of said bridge circuit energizing said drive motor windings during the harvest cycle of said ice maker, and whereby during the harvesting cycle said heating means supplying heat to said tube to insure said mercury thermostat wire contacts being closed by the liquid mercury upon completion of the ice harvest cycle thereby short circuiting said diode bridge until the freezing of the next water charge in said tray cavities.

* * * * *